US005598646A

United States Patent [19]

Paris

[11] Patent Number: 5,598,646

[45] Date of Patent: Feb. 4, 1997

[54] SKI BOOT

[75] Inventor: Jean Paris, Sevrier, France

[73] Assignee: Salomon S.A., Annecy, France

[21] Appl. No.: 894,627

[22] Filed: Jun. 5, 1992

[30] Foreign Application Priority Data

Jun. 10, 1991 [FR] France ..... 91 07266

[51] Int. Cl.[6] ..... A43B 5/04

[52] U.S. Cl. ..... 36/118.7

[58] Field of Search ..... 36/117–121

[56] References Cited

U.S. PATENT DOCUMENTS

| | | | |
|---|---|---|---|
| 3,570,148 | 3/1971 | Morgan | 36/121 |
| 3,722,112 | 3/1973 | Morgan | 36/121 |
| 4,085,528 | 4/1978 | Delery | 36/121 |
| 4,265,034 | 5/1981 | Salomon | 36/121 |
| 4,349,971 | 9/1982 | Everest, III | 36/121 |
| 4,937,953 | 7/1990 | Walkoff | 36/119 |
| 5,136,794 | 8/1992 | Stampacchia et al. | 36/121 |

FOREIGN PATENT DOCUMENTS

| | | |
|---|---|---|
| 0286586 | 10/1988 | European Pat. Off. . |
| 2341283 | 6/1977 | France . |
| 2454767 | 11/1980 | France . |
| 3120955 | 3/1982 | Germany . |
| 549970 | 6/1974 | Switzerland . |
| WO89/04615 | 6/1989 | WIPO . |

*Primary Examiner*—Marie D. Patterson
*Attorney, Agent, or Firm*—Greenblum & Bernstein P.L.C.

[57] ABSTRACT

Ski boot of the overlapping type, including a rigid shell base surmounted by an upper, the upper including in its front portion an upward extension of the shell base, and in its rear portion, a rigid rear spoiler journalled with respect to the shell base, and a tightening arrangement being distributed along the front surface of the boot, whereas the control arrangement for the position of advance are arranged between the shell base and the upper, wherein at least one element of the tightening arrangement is located in the zone of the flexion fold directly on the shell base, and whereas the top of the upper that tightens the lower part of the leg of the skier is provided with another tightening arrangement fixed at the front upper end of the rear spoiler encircling the front upper zone of the extension of the shell base.

17 Claims, 2 Drawing Sheets

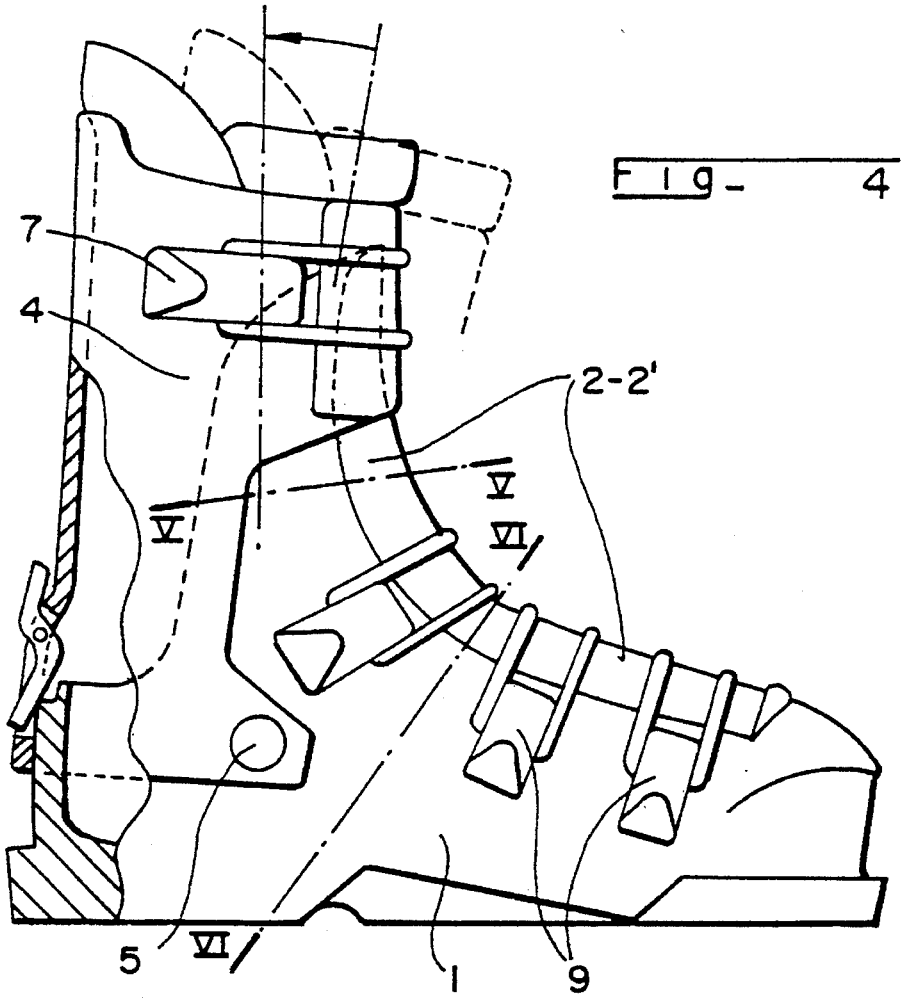
Fig- 4
Fig- 5
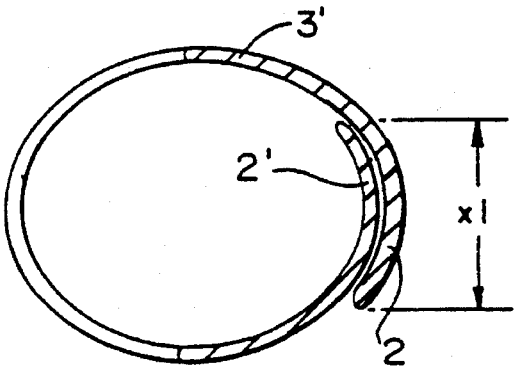
Fig- 6
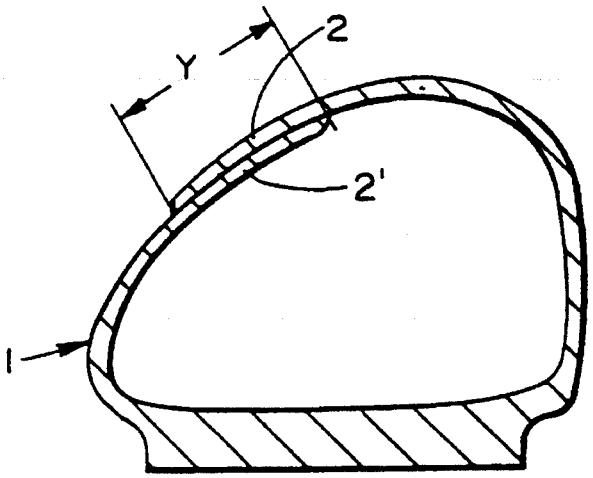

SKI BOOT

BACKGROUND OF THE INVENTION

1. Field of the Invention

The invention is related to an improvement for ski boots. More particularly, the present invention is related to a ski boot having a shell base adapted to surround the foot, and an upper portion adapted to envelope the lower part of the leg of the skier, capable of comprising at least one integral piece. This upper portion is, furthermore, journalled on the shell base and is capable of pivoting towards the rear by virtue of the unlatching of an abutment system, that enables the boot to be more easily put on, as well as a so-called resting position, without it being necessary to modify the initial tightening of the upper on the lower part of the leg when the boot according to the invention is put on by the skier. Advantageously, these functions of the boot according to the invention are obtained by manipulating a single element controlling the unlatching of the abutment system, thereby achieving a rotational release about an axis substantially in the area of the axis of the malleoli of the leg of the skier with respect to the shell base.

2. Description of Background and Material Information

Prior state of the art includes a certain number of ski boots whose structures were aimed at achieving the same results of releasing the upper with respect to the shell base. However, the structures described neither comprise the same means nor the same functions as those of the boot according to the invention.

Thus, the boot according to the European Patent Application EP 286,586 includes a construction enabling the skier who wishes to relax or walk, to unlatch one of the rear portions constituting the upper of the boot with respect to the shell by pressing on a rocking lever connected to a spring, thereby enabling him to bring the leg back into a more or less vertical position, and enabling the upper assembly thus released to pivot about its journal on the shell base.

Although the function of releasing the upper with respect to the shell base is, in fact, achieved in this instance, it is done at the cost of a relatively complex and expensive boot structure described therein. Indeed, in this case, one is faced with a plurality of upper portions assembled pivotally with respect to one another, which, when called upon to respond to the anatomical necessities of the articulations of the feet, generate interdependent movements between themselves, adversely affecting precision skiing.

The manufacturer realized the disadvantages of these boots after having commercialized them, and tried to overcome these by offering the consumers a boot which was conceived according to a second embodiment of the invention, and commercialized under the name "MID 4-8".

With this new boot, the objects of structural simplicity and cost reduction were apparently resolved, but this was done at the detriment of the release function of the angle of advance of the upper with respect to the shell base, which suffered substantially. In fact, what one finds here is a boot of the front entry type, as described, for example, in Swiss Patent CH 549,970.

In another embodiment described in International Patent Application WO 89/04615, a boot of the central entry type is disclosed whose upper, comprising three distinct portions, all journalled with respect to the shell base, comprises a blocking-unblocking mechanism for its position of advance. This mechanism, although it permits movement from a skiing position to a walking position of the boot closed on the foot of the skier, it does not, however, enable good foot retention, especially in the area of the flexion fold.

SUMMARY OF THE INVENTION

An object of the present invention is to overcome the disadvantages of alpine ski boots such as those described hereinabove as prior state of the art, and especially those boots with journalled uppers constituted by a plurality of parts that must have release functions, and if required, adjustment functions for its position of advance, whereby one can move from the so-called skiing position to a resting position, and at the same time, conserve a good retention of the foot in the boot.

To this end, the present invention comprises an alpine ski boot of the overlapping type, having a release and/or adjustment function for the position of advance of the upper journalled with respect to the shell base, wherein it ensures good retention of the foot in the area of the flexion fold, including during release of the upper in the resting position, with the minimum of elements constituting the upper, such elements being assembled together in a simple and inexpensive manner.

The structure of the ski boot of the overlapping type according to the invention comprises a rigid shell base surmounted by an upper, the upper having in its front portion an upward extension of the shell base, and in its rear portion, a rigid rear spoiler journalled with respect to the shell base, the tightening means being distributed all along the front surface of the boot, whereas the control means of the position of advance are arranged in the rear portion of the upper between the shell base and the upper, and at least one of the tightening means being located in the area of the flexion fold directly on the shell base, whereas the top of the upper that tightens the lower part of the leg of the skier is provided with another tightening means fixed at the upper end of the rear spoiler which encircles, by means of two lateral flaps, the upper front area of the extension of the shell base comprising two flexible flaps that cover one another in the operational position.

According to another characteristic of the invention, the journal of the rear spoiler on the shell base is preferably localized in an area located beneath the tightening means arranged in the zone of the flexion fold.

Still within the scope of the invention is another characteristic concerning the control means for the position of advance that can be unlatched in such a way so as to enable a certain amount of movement of the upper with respect to the shell base.

BRIEF DESCRIPTION OF THE DRAWINGS

Other characteristics and advantages of the invention will become clearer upon reading the description that follows with respect to the annexed drawings that are provided as non-limiting examples only.

FIG. 4 represents the ski boot according to FIG. 1 in a so-called resting position of the upper on the shell base; and FIGS. 5 and 6 are views similar to FIGS. 2 and 3 respectively illustrating a sectional view of the sections of the shell base according to FIGS. 2 and 3 for the so-called resting position, enabling a certain freedom of movement.

DETAILED DESCRIPTION OF THE PREFERRED EMBODIMENTS

Figure 1:
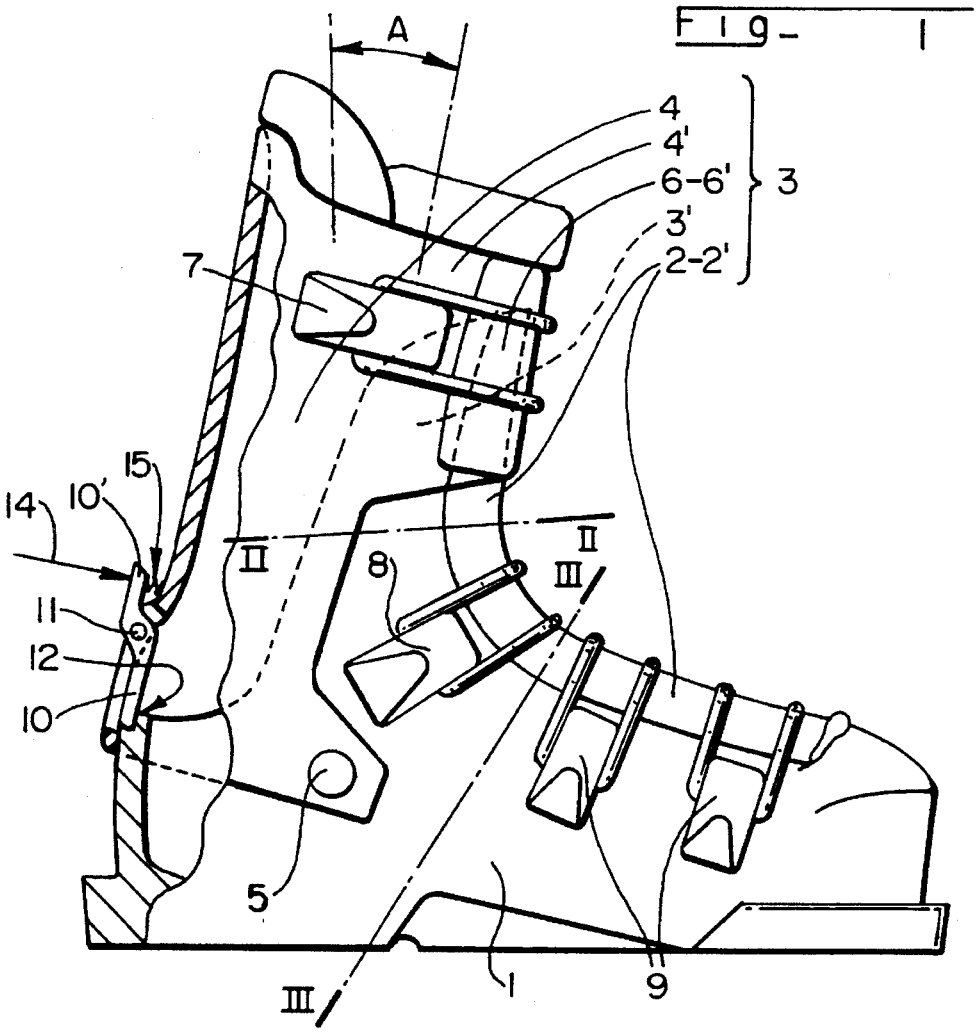
FIG. 1 represents a partial sectional lateral view of an alpine ski boot as defined by the invention, in the skiing position.
Figure 2:
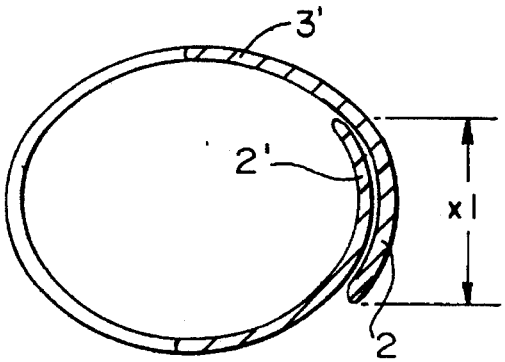
FIGS. 2 and 3 are sectional views along lines II—II and III—III of FIG. 1, illustrating different sections of the shell base.
Figure 3:
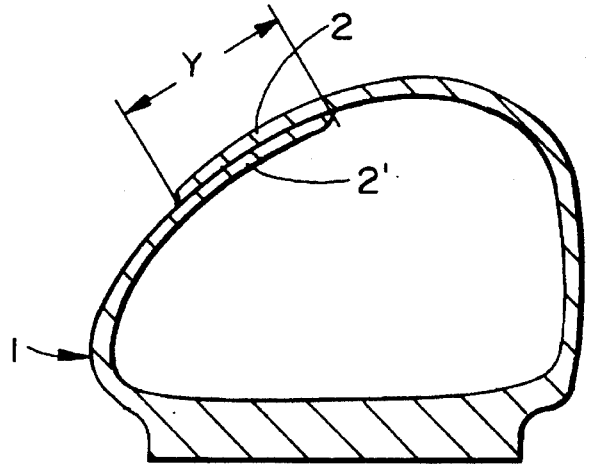

The alpine ski boot according to the invention, that is represented in FIGS. 1–6, is of the overlapping type and comprises a rigid shell base 1, adapted to encircle the foot of the skier, and provided on its entire front upper surface, with extensions of the shell base defining flaps 2, 2', overlapping on the front surface of the top of the boot, the flaps being adapted to cover one another and to close the boot both on the front area of the lower part of the leg, as well as on the top of the foot of the skier. Advantageously, these flaps 2,2' have, substantially from the area of flexion, mechanical properties that are more flexible than those of the shell base, and extend at least partially laterally and frontwardly from each side of the lower part of the leg in such a way so as to constitute the front portion 3' of upper 3 of the boot.

A rear spoiler 4 is mounted in a journalled manner on the shell base at the area of a journal axis, represented on each side of the boot by a rivet 5, such that rear spoiler 4 can pivot with respect to the shell base. The rear spoiler 4 and the front portion 3' overlap each other laterally from each side of the upper 3 that they define, in order to tighten the leg of the skier. The upper portion 4' of rear spoiler 4 is provided with two extensions 6, 6' extending frontwardly from upper 3 so as to cover, by overlapping, the front portion 3' of the upper. These two extensions 6, 6' are respectively provided with closing and tightening means, for the lower part of the leg, such as for example a buckle-hook 7.

In order to perfect the closure and tightening of the boot, shell base 1 is further provided with other closure and tightening means (hooks with buckles or straps) arranged according to a well-defined arrangement along the top of the boot. Thus, a hook 8 is arranged on each of flaps 2, 2' of the shell base along a diagonal orientation, in the area of the flexion fold of the boot, i.e., in the area forward of the ankle joint, near the intersection of the top part of the foot and the front of the lower leg, so as to ensure good retention of the heel in the boot. Finally, two other hooks 9 are arranged more at the front of the shell along an arrangement that is transverse with respect to the longitudinal axis of the boot, so as to enable a good retention and enveloping of the front of the foot of the skier.

The control means of the position of advance of the upper are arranged on the rear spoiler, preferably in the lower rear area of the latter, so as to block the pivoting of the upper in the front-to-rear direction. These control means of the position of advance comprise an unlatchable catch system 10 that the skier can manipulate according to his or her requirements, depending on whether he or she wishes to obtain the so-called skiing position (FIG. 1), or the so-called resting position (FIG. 4).

Indeed, from the skiing position, in which the unlatchable catch 10 journalled on rear spoiler 4 about an axis 11 is in abutment against the upper edge 12 of the heel of the shell base in a support housing 13 provided to this end, the skier can, at will, exert a pressure (along arrow 14 of FIG. 1) on the maneuvering lever 10' of the catch. This pressure permits the rotation of the rear spoiler 4 with respect to the shell base by disengaging the catch from its support housing 13, and the leg of the skier thus passes from a skiing position for a given angle of initial advance of the catch. This pressure thus has the effect of freeing the rotation of the rear spoiler 4 with respect to the shell base by disengaging the catch from its support housing 13, the leg of the skier thus passing from the skiing position for a given angle A of initial advance with respect to the vertical, to the resting position, joining this vertical such as represented in FIG. 4. It could be advantageous to insert, between manoeuvering lever 10' and the wall of rear spoiler 4, elastic compression means 15 enabling the catch to be maintained in its abutment position against edge 12.

Naturally, sealing means, not represented, are provided at the level of the opening in the lower wall of the rear spoiler where the unlatching system of the upper is located, in order to stop all penetration of snow or water in the boot.

Thus, when the skier decides to come back to the skiing position, he flexes in the frontward direction in such a way that the catch, which is permanently connected to the compression means and slides along the wall of the heel of the shell base, clicks in its support housing 13 provided on the edge of the heel, and thus brings back the upper to its position of initial advance A with respect to the shell base characterizing the position of the ski boot.

By virtue of the boot according to the invention, this return to the skiing position is done without any manipulation of the different closure hooks, whose tightening forces have remained unmodified by the skier, regardless of the passage of the upper with respect to the shell base from one operational position to the other.

The specific configuration of the various component parts of the boot according to the invention enables a particularly advantageous functioning method when the skier uses the resting position.

Indeed, the cooperation of the tightening means of the lower part of the leg with the deformation of flaps 2, 2' of the front portion 3' of the upper generates (when the catch is unlatched) an excellent tibial retention of the boot on the leg and at the same time, enables a rear support retention of the leg which, although flexible, is sufficient to retain a good balance. In this configuration, the tightening means 8 and 9 are not modified and thus contribute to ensuring excellent retention of the foot in the boot, whereas the lower part of the leg of the skier acquires a certain freedom of movement with respect to the shell base. It must be noted in this respect however, that in the hypothesis that the tightening means 8 of the zone of the flexion fold is fixed not on the shell base itself, but on the lateral walls of rear spoiler 4, the functioning of the boot according to the invention cannot be obtained because the rearward movement of the spoiler generates excess pressure in the zone of the flexion fold, and would be blocked because of the overlapping double canvas construction of the zone, thereby rendering it extremely rigid, the pivoting movement of the spoiler towards the rear consequently being rendered extremely difficult and limited, almost reducing this boot to complete uselessness.

Thus, it is important that the tightening means 8 of the zone of the flexion fold of the boot be fixed on the lateral walls of the shell base. Thus, any movement of the upper would only originate from the journal of the rear spoiler of the shell base and the deformation of flaps 2, 2' of the front portion 3' of the upper, as illustrated respectively in FIGS. 3 and 5, where one notes that the overlapping zone of flaps 2, 2' is represented by side "x" in the skiing position, by side "$x_1$" in the resting position, the value of "x" being greater than "$x_1$". In parallel, and for each of the skiing or resting positions, the value "y" of the overlapping zone of flaps 2, 2' in the zone of the flexion fold remains unchanged due to the rigid structure of the shell base in these areas.

For details that have not been expressly described, persons of ordinary skill in the art can refer to the annexed drawings. Further, the instant application is based upon French patent application 91.07266, filed on Jun. 10, 1991, the disclosure of which is hereby expressly incorporated by reference thereto, and the priority of which is hereby claimed.

The invention is not limited to the embodiments described and represented as examples herein, but also comprises all equivalents thereof, as well as combinations thereof with other related structures.

What is claimed:

1. A ski boot comprising:

a shell base including a rigid material, said shell base including a top surface, the top surface including an area of flexion, the shell base further including a heel area, the heel area having an upper edge;

an upper, including a front surface, and further comprising:

a front portion comprising an upward extension of the shell base, including two flexible flaps extending at least from the area of flexion of the shell base, the two flexible flaps at least partially overlapping in a tibial support zone of the boot and extending at least partially laterally towards the rear; and a rear portion comprising a rigid rear spoiler journalled at a journal axis with respect to the shell base, the rear spoiler including a front upper end surrounding the upward extension of the shell base, the rear spoiler also including a rear lower zone;

a plurality of tightening devices, including at least one tightening device positioned at the area of flexion on the top surface of the shell base and at least one tightening device positioned at the front surface of the upper on the front upper end of the rear spoiler; and a single manipulable element arranged between a portion of the shell base and a portion of the upper for controlling the position of the upper with respect to the shell base, the single element for controlling the position of the upper with respect to the shell base comprising a releasable catch journalled around an axis located in the rear lower zone of the rear spoiler, the catch being engageable in abutment in a support housing arranged in the upper edge of the heel of the shell base.

2. The ski boot of claim 1, wherein:

the front upper end of the rear spoiler comprises two laterally extending flaps overlapping at the front surface of the upper; and the at least one tightening device positioned at the front surface of the upper is positioned on at least one of the two laterally extending flaps of the front upper end of the rear spoiler.

3. The ski boot of claim 1, wherein:

the rigid rear spoiler is journalled with respect to the shell base about a journal axis located beneath the tightening device positioned at the area of the flexion of the shell base.

4. The ski boot of claim 1, wherein:

the catch comprises a maneuvering lever and an elastic compression device supported against a surface of the rear spoiler for biasing the catch in a direction for engagement.

5. The ski boot of claim 1, wherein:

the tightening device positioned at the area of flexion of the front surface of the shell base comprises means for generating a tightening force diagonally toward a heel area of the boot.

6. An alpine ski boot comprising:

a shell base including a rigid material, said shell base including a top surface, the top surface including an area of flexion;

an upper, including a front surface, and further comprising:

a front portion comprising an upward extension of the shell base, including two flexible flaps extending at least from the area of flexion of the shell base, the two flexible flaps at least partially overlapping in a tibial support zone of the boot and extending at least partially laterally towards the rear; and a rear portion comprising a rigid rear spoiler journalled at a journal axis with respect to the shell base, the rear spoiler including a front upper end surrounding the upward extension of the shell base;

a plurality of tightening devices, including at least one tightening device positioned at the area of flexion on the top surface of the shell base and at least one tightening device positioned at the front surface of the upper on the front upper end of the rear spoiler, the tightening device positioned at the area of flexion of the front surface of the shell base comprising means for generating a tightening force diagonally toward a heel area of the boot and above the journal axis of the rear spoiler; and a single manipulable element arranged between a portion of the shell base and a portion of the upper for controlling the position of the upper with respect to the shell base.

7. A ski boot comprising:

a shell base;

an upper mounted above the shell base, said upper including a rear spoiler journalled at a journal axis with respect to the shell base;

means for mounting a portion of said upper for pivotal movement with respect to said shell base between a skiing position and a rest position, said rest position being rearwardly displaced from said skiing position;

means for adjusting a tightening force on said upper of the ski boot about the lower leg and for securing the lower leg in a predetermined manner for skiing;

means for adjusting a tightening force on said shell base of the ski boot about the foot and for securing the foot in a predetermined manner for skiing comprising a tightening device for applying a force at a flexion area on said shell base directed diagonally toward a heel area of the boot and above the journal axis of the rear spoiler for securing the heel of the foot within the ski boot; and means for selectively controlling a position of said upper portion with respect to said shell base without adjusting said tightening forces of said upper portion and said shell base with any of said means for adjusting.

8. The ski boot of claim 7, wherein:

said means for selectively controlling a position of said upper portion with respect to said shell base comprises a single manipulable control element for said selectively controlling, said single manipulable control element being located between said upper portion and said shell base and being movable between an engaged position for securing said upper portion in a position of advance with respect to said shell base in said skiing position of the ski boot and a disengaged position for releasing said upper portion from engagement with respect to said shell base in said rest position.

9. The ski boot of claim 7, wherein:

said means for mounting said upper portion for movement comprises means for mounting said rear spoiler for pivoting between said rest position and said skiing position, said skiing position being forwardly advanced from said rest position.

10. The ski boot of claim 9, wherein:

said rear spoiler comprises a pair of forwardly extending flaps, one of said pair of flaps overlapping the other in a front portion of the ski boot;

said means for adjusting a tightening force on said upper portion of the ski boot about the lower leg and for securing the lower leg in a predetermined manner for skiing comprises at least one tightening device mounted on at least one of said pair of flaps for tightening said pair of flaps about the lower leg.

11. The ski boot of claim 10, wherein:

said shell base has an upper surface comprising said flexion area; and said forwardly extending flaps have forwardly facing bottom edges positioned above said flexion area of said upper surface of said shell base.

12. A ski boot comprising:

a shell base;

an upper mounted above the shell base;

means for mounting a portion of said upper for movement with respect to said shell base between a skiing position and a rest position, said rest position being rearwardly displaced from said skiing position;

means for adjusting a tightening force on said upper of the ski boot about the lower leg and for securing the lower leg in a predetermined manner for skiing;

means for adjusting a tightening force on said shell base of the ski boot about the foot and for securing the foot in a predetermined manner for skiing;

means for selectively controlling a position of said upper portion with respect to said shell base without adjusting said tightening forces of said upper and said shell base with any of said means for adjusting;

said means for adjusting a tightening force on said shell base of the ski boot about the foot comprises a tightening device for applying a force at a flexion area on the shell base and directed at least in a direction for securing the heel of the foot within the ski boot and diagonally toward a rear end of said heel area of the boot.

13. An alpine ski boot comprising:

a shell base;

an upper comprising a rear spoiler, said rear spoiler being journalled with respect to said shell base between (1) a first boot configuration, in which said rear spoiler is forwardly positioned with respect to said shell base for skiing, and (2) a second boot configuration, in which said rear spoiler is permitted to move rearwardly from said first configuration;

at least a first device for adjusting a tightening force of said upper of the ski boot about the lower leg at a magnitude for securing the lower leg in a predetermined manner for skiing;

at least a second device for adjusting a tightening force of said shell base of the ski boot about the foot at a magnitude for securing the foot in a predetermined manner for skiing, said second device comprising a tightening device for applying a tightening force at a flexion area of said shell base directed at least diagonally toward a rear end of a heel area of the boot for securing the heel of the foot within the ski boot; and a latch for securing said rear spoiler with respect to said shell base in said first boot configuration and for releasing said rear spoiler from said shell base in said second boot configuration independently of adjustment of any said first device.

14. The ski boot of claim 13, wherein:

said latch comprises a single manipulable control element located between said rear spoiler and said shell base movable between (1) an engaged position for securing said rear spoiler with respect to said shell base in said first configuration and, without adjusting either of said tightening force of said upper and said tightening force of said shell base, and (2) a disengaged position for permitting rearward movement of said rear spoiler with respect to said shell base in said second configuration.

15. The ski boot of claim 13, wherein:

said rear spoiler comprises a pair of forwardly extending flaps, one of said pair of flaps overlapping the other in a front portion of the ski boot;

said at least a first device for adjusting a tightening force of said upper of the ski boot about the lower leg comprises at least one tightening device mounted on at least one of said pair of flaps for tightening said pair of flaps about the lower leg.

16. The ski boot of claim 15, wherein:

said shell base has an upper surface comprising said flexion area; and said forwardly extending flaps have forwardly facing bottom edges positioned above said flexion area of said upper surface of said shell base.

17. An alpine ski boot comprising:

a shell base;

an upper comprising a rear spoiler, said rear spoiler being journalled with respect to said shell base between (1) a first boot configuration, in which said rear spoiler is forwardly positioned with respect to said shell base for skiing, and (2) a second boot configuration, in which said rear spoiler is permitted to move rearwardly from said first configuration;

at least a first device for adjusting a tightening force of said upper of the ski boot about the lower leg at a magnitude for securing the lower leg in a predetermined manner for skiing;

at least a second device for adjusting a tightening force of said shell base of the ski boot about the foot at a magnitude for securing the foot in a predetermined manner for skiing, said second device comprising tightening device for applying a tightening force at a flexion area of said shell base directed at least diagonally toward a heel area of the boot and above the journal axis of the rear spoiler for securing the heel of the foot within the ski boot; and a latch for securing said rear spoiler with respect to said shell base in said first boot configuration and for releasing said rear spoiler from said shell base in said second boot configuration independently of adjustment of any said first device.

* * * * *